US005182903A

United States Patent [19]

Stahlecker

[11] Patent Number: 5,182,903

[45] Date of Patent: Feb. 2, 1993

[54] OPEN-END SPINNING MACHINE

[75] Inventor: Fritz Stahlecker, Bad Überkingen, Fed. Rep. of Germany

[73] Assignees: Fritz Stahlecker; Hans Stahlecker, both of Fed. Rep. of Germany; a part interest

[21] Appl. No.: 836,761

[22] Filed: Feb. 19, 1992

[30] Foreign Application Priority Data

Mar. 8, 1991 [DE] Fed. Rep. of Germany ..... 4107403

[51] Int. Cl.[5] ..... D01H 11/00

[52] U.S. Cl. ..... 57/301; 57/304

[58] Field of Search ..... 57/300, 301, 302, 304, 57/305

[56] References Cited

U.S. PATENT DOCUMENTS

| | | | |
|---|---|---|---|
| 4,038,812 | 8/1977 | Stahlecker | 57/304 X |
| 4,089,155 | 5/1978 | Stahlecker | 57/305 X |
| 4,159,620 | 7/1979 | LaFlaquiere et al. | 57/301 |
| 4,192,129 | 3/1980 | Stahlecker | 57/301 |
| 4,484,434 | 11/1984 | Rümmele | 57/304 |
| 4,835,957 | 6/1989 | Stahlecker et al. | 57/301 |
| 4,864,679 | 9/1989 | Briner | 57/301 |

FOREIGN PATENT DOCUMENTS

| | | |
|---|---|---|
| 0259622 | 3/1988 | European Pat. Off. . |
| 2350840 | 4/1975 | Fed. Rep. of Germany . |
| 2458538 | 6/1976 | Fed. Rep. of Germany . |
| 2658441 | 6/1978 | Fed. Rep. of Germany . |

*Primary Examiner*—Joseph J. Hail, III

*Attorney, Agent, or Firm*—Evenson, Wands, Edwards, Lenahan & McKeown

[57] ABSTRACT

On an open-end spinning machine having a plurality of spinning units arranged in a row, a servicing apparatus is movably arranged on which cleaning elements are provided which can be applied to the environment of an opening roller and therefore clean it. A control device is assigned to the cleaning elements which controls a first cleaning operation when servicing apparatus is moving and a second cleaning operation when the servicing apparatus is stopped. Thus, a cleaning is possible which is adapted to the moving condition of the servicing apparatus.

23 Claims, 3 Drawing Sheets

OPEN-END SPINNING MACHINE

BACKGROUND AND SUMMARY OF THE INVENTION

This invention relates to open-end spinning machine having a plurality of spinning units arranged in a row which each comprise an opening roller, to the environment of which cleaning elements of a movable servicing apparatus can be applied while the spinning operation is not interrupted.

In the case of such a spinning machine, the area of the spinning units, particularly the area of the opening roller, must be cleaned at regular intervals in order to minimize the danger of yarn breakages. If this cleaning takes place manually, a group of three to four persons per machine needs at least half a day and the spinning operation must be interrupted in this case. During the spinning operation, the yarn breakage situation deteriorates continuously because of the accumulating dirt.

On the basis of the German Patent Document DE-A 24 58 538, it is known to clean the dirt collecting chamber assigned to an opening roller without any significant impairment of the spinning operation. For this purpose, connection openings for blowing and suction devices as well as possibly mechanical elements are provided on the covering of the opening roller. The cleaning operation takes place while the servicing apparatus is stopped. In the case of another known embodiment, which is described in the above-mentioned text, additional areas may also be cleaned while the spinning unit is stopped, for example, the opening roller itself as well as a fiber feeding duct leading from the opening roller to the spinning rotor.

From the German Patent Document DE-PS 23 50 840, an open-end spinning machine with a movable servicing apparatus is known. In this case, the servicing apparatus is divided into structural components. While one structural component eliminates a yarn breakage on a stopped spinning unit, the other structural component can carry out preparatory work, such as a cleaning operation, on an adjacent stopped spinning unit.

The European Patent Document EP-A 0 259 622 describes a programmable suction device for use on an open-end spinning machine. The suction device is arranged to be movable along the spinning units of the spinning machine. Predetermined elements of the spinning station are subjected to suction while the suction device is stopped. As a programming variant for this suction device, it is suggested in this patent text that the suction device in one operating cycle vacuums, for example, only the elements which are most susceptible to becoming dusty and, in a subsequent operating cycle, a more comprehensive cleaning is carried out.

On the basis of the German Patent Document DE-A 26 58 441, it is finally known to provide a cleaning head on a movable cleaning device which can be applied to a spinning unit and which, in turn, is stripped by cleaning devices of the movable apparatus.

It is an object of the invention to suggest an openend spinning machine of the initially mentioned type in which, during the moving operation of the servicing apparatus as well as when this servicing apparatus is stopped, a cleaning of the environment of the opening roller can be carried out while the spinning operation is not interrupted.

According to the invention, this object is achieved in that a control device is assigned to the cleaning elements which controls a first cleaning operation when the servicing apparatus is moving and a second cleaning operation when the servicing apparatus is stopped.

By means of this development, it is possible to adapt the cleaning operation to the moving condition of the servicing apparatus. This takes the circumstance into account that the cleaning while the servicing apparatus is moving must be carried out in a different manner than while it is stopped. By means of the preventive cleaning of the environment of the opening roller, which is carried out during the spinning operation, it is achieved that the yarn breakage situation resulting from accumulating dirt can be improved significantly. In addition, the servicing apparatus is utilized better because cleaning operations can be carried out while it is moving as well as while it is stopped.

In a further development, the cleaning operation while the servicing apparatus is stopped is designed for an intensive cleaning, and the cleaning operation while the servicing apparatus is moving is designed for a less intensive cleaning. When the servicing apparatus is stopped, that is, particularly during the elimination of a yarn breakage at an adjacent spinning station, cleaning measures can be carried out which are not possible when the servicing apparatus is moving. For example, while the servicing apparatus is stopped, cleaning elements can be introduced into the depth of the area surrounding the opening roller. It should be noted that the cleaning while the servicing apparatus is stopped has nothing in common with the cleaning of a spinning station which as a rule precedes, for example, the elimination of a yarn breakage. The invention relates to cleaning operations which are carried out preventively while the spinning operation is not interrupted.

In an advantageous development, the control device is constructed to be programmable by means of at least two control programs. A first control program is used for the control of the cleaning elements during a cleaning operation carried out while the servicing apparatus is moving. In contrast, the second control program controls the cleaning operation while the servicing apparatus is stopped.

It may advantageously be provided that the servicing apparatus is equipped with at least two different cleaning elements, in which case a first cleaning element is designed for the cleaning operation while the servicing apparatus is moving, and another cleaning element is designed for the cleaning operation when the servicing apparatus is stopped. As a result, it is achieved that for the cleaning operation while the servicing apparatus is moving, different cleaning elements are available than for the cleaning operation while the servicing apparatus is stopped. The control device assigned to the cleaning elements controls the cleaning elements as a function of the moving condition of the servicing apparatus. In this case, a signal which indicates the moving condition of the servicing apparatus is tapped, for example, from the driving motor of the servicing apparatus and is fed to the control device controlling the cleaning elements.

In this case, it may advantageously be provided that the cleaning element which is used when the servicing apparatus is moving is constructed with at least one pneumatic element, and the cleaning element which is used when the servicing apparatus is stopped is constructed with at least one pneumatic and/or mechanical element. Pneumatic elements are suction and blowing devices which are connected with an air-carrying pipe.

The mechanical elements to be used may have different constructions. In particular, a stripping wheel, a roll-picker needle or a brush may be used for the intensive cleaning of the environment of the opening roller. When the servicing apparatus is moving, only pneumatic elements are used, while when the servicing apparatus is stopped, it is also possible to use such mechanical elements. When the servicing apparatus is stopped, these may be introduced deep into the area to be cleaned.

In an advantageous development, the different cleaning elements are assigned to one cleaning head respectively which is pivotally arranged on the servicing apparatus. As a function of the moving condition of the servicing apparatus, the respective cleaning head is guided to the area to be cleaned.

Accordingly, one cleaning head respectively is provided for the moving operation of the servicing apparatus and one cleaning head is provided for the stoppage of the servicing apparatus.

The stripping of the cleaning elements, particularly of dirt particles and fiber residues adhering to them, advantageously takes place by the application of a cleaning element which strips the cleaning elements. This may advantageously be constructed inside the servicing apparatus as a stripping cleaning head.

In a further development, it may be provided that the cleaning element for the cleaning operation when the servicing apparatus is stopped can be applied to a spinning unit which is adjacent to the spinning unit serviced by the cleaning arrangement. While the spinning unit to be serviced is rendered inoperative, a preventive cleaning may be carried out at the adjacent operative spinning unit. Since the servicing apparatus is stopped, the cleaning operation can be carried out intensively; that is, particularly by using pneumatic and mechanical elements.

Furthermore, it is contemplated that the position of the cleaning elements can be programmed to be variable with respect to the areas to be cleaned. As a result, it is advantageously achieved that an extensive environment of the opening roller can be subjected to a cleaning operation. By changing the position of the cleaning elements, additional cleaning elements are not required. It may, for example, be provided to control a roll-picker needle with its bearing and its drive in such a manner that during each cycle it cleans a different part of the spinning unit. In this case, the control may be developed in such a manner that such a roll-picker needle can be inserted even when the servicing apparatus is moving. When the roll-picker needle is pivotally held in the servicing arrangement, it is possible to give the roll-picker needle a different direction at desirable time intervals. For example, first the area below a trough table assigned to a feeding roller can be cleaned, while, during a further pass, the roll-picker needle removes fly residue which always catches in the proximity of the feeding hopper. In the case of a third pass, for example, a particularly endangered point of a dirt discharge opening assigned to the opening roller could be serviced.

In a further development of this invention, it may advantageously be provided that the control program assigned to the moving operation can be changed during each cycle of the servicing apparatus. This may take place for example by a signal emitter mounted on the open-end spinning machine which comes in contact with it during each cycle of the servicing apparatus.

In a further development, the area of the opening roller of each spinning unit is freely accessible for the cleaning elements. As a result, a cleaning is achieved that is not hindered particularly when the servicing apparatus is moving. In the case of one embodiment, only the front-face area of the opening roller is provided with a covering. In contrast, the area arranged below the opening roller is freely accessible to the cleaning elements.

In a further development of the invention, the area of the opening roller is provided with a covering that can be swivelled away. The swivelling-away of the covering advantageously takes place by means of the servicing apparatus.

Furthermore, it may be advantageous for the cleaning element, when the servicing apparatus is moving, to be provided with a suction bell which is constructed to surround the area to be cleaned. During the stripping operation, such a suction bell permits the covering of the respective spinning station so that mechanically stripped dirt particles can be caught securely. In this case, the cleaning elements for the moving operation of the servicing apparatus are advantageously arranged inside the suction bell.

Other objects, advantages and novel features of the present invention will become apparent from the following detailed description of the invention when considered in conjunction with the accompanying drawings.

DETAILED DESCRIPTION OF THE DRAWINGS

Figure 1:
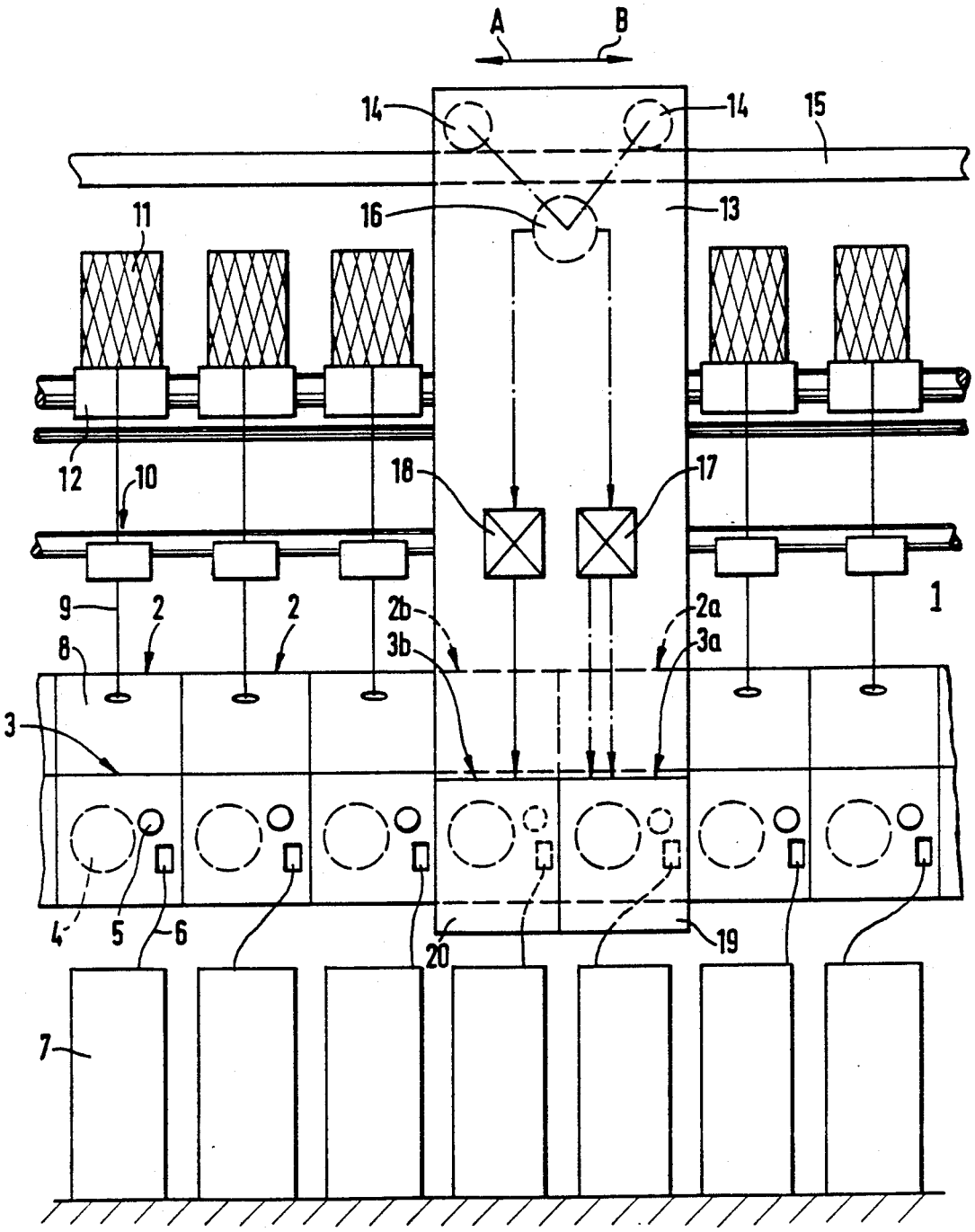
FIG. 1 is a schematic frontal view of a part of an open-end spinning machine according to the invention with a movable servicing apparatus.
Figure 2:
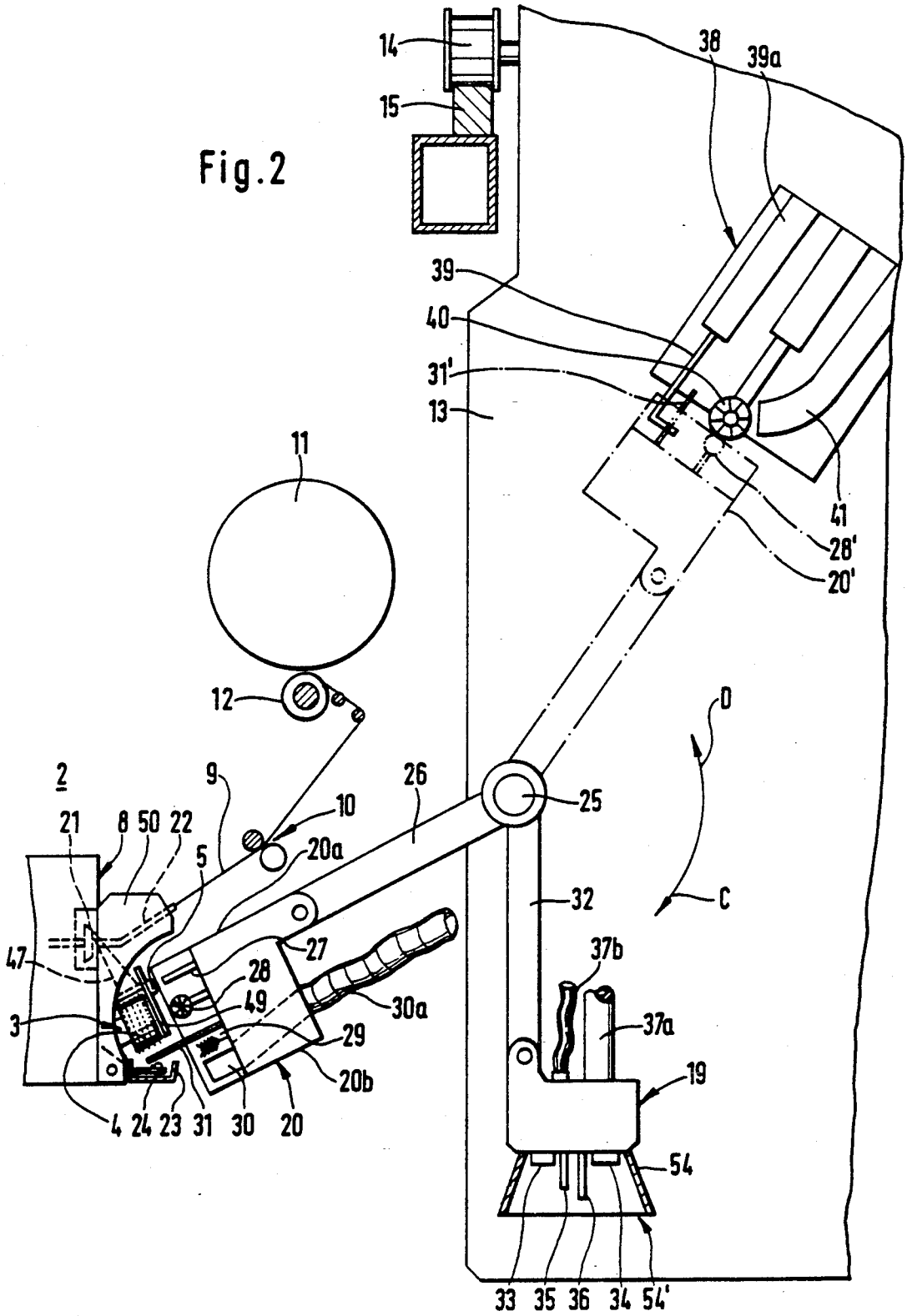
FIG. 2 is a schematic lateral view of a spinning unit of the open-end spinning machine according to FIG. 1.

The open-end spinning machine 1 illustrated in FIG. 1 comprises a plurality of spinning units 2 arranged next to one another. Each of these spinning units 2 has an area 3 which may be considered as the environment of an opening roller 4. One feeding roller 5 respectively is assigned to the opening rollers 4 of the individual spinning units 3. A sliver 6 to be spun is fed to this feeding roller 5 from a sliver can 7. The respective feeding roller 5 then offers the sliver 6 in the form of a tuft to the rapidly running opening roller 4 which opens up the sliver 6 into individual fibers. As shown in FIG. 2, the individual fibers are fed by way of a fiber feeding duct 47 to a spinning rotor 21 which is arranged in the spinning part 8 of the respective spinning unit 2. The spun yarn 9, by way of a tube guide 22 which extends inside a covering 50, is withdrawn by a withdrawal device 10 and is wound onto a wind-up spool package 11 to which one winding roller is assigned for each spinning unit 2.

A servicing apparatus 13 whose running wheels 14 are guided on a moving rail 15 can be moved along the open-end spinning machine 1 corresponding to the directions of the arrows (A) and (B) according to FIG. 1. At least one of the running wheels 14 is driven by a driving motor 16 of the servicing apparatus 13.

By means of the servicing apparatus 13, servicing operations can be carried out on a stopped spinning unit 2, in FIG. 1, for example, the spinning unit 2*a*. In particular, it is possible to eliminate a yarn breakage on the stopped spinning unit 2*a*. In the case of such a servicing operation, the servicing apparatus 13 is moved into the position illustrated in FIG. 1.

As indicated in FIG. 2, two cleaning heads 19 and 20 are pivotally disposed on a horizontal shaft in the servicing apparatus 13. Drives, which are not shown in detail, permit the swivelling movement of the cleaning heads 19, 20 in the direction of the arrows (C, D). Apart from the cleaning elements of various constructions which will be discussed later, the cleaning heads 19, 20 in principle have the same construction. Both cleaning heads 19, 20 have a bell shape and are fastened to a swivel arm 26 and 32 which is pivotally disposed on the horizontal shaft 25.

First, the cleaning head 19 provided for the moving operation of the servicing apparatus 13 will be described. On the front face of the cleaning head 19, pneumatic cleaning elements 33, 34, 35, 36 are arranged. The cleaning elements are constructed as two suction pipes 33, 34 which accommodate two blowing nozzles 35, 36 between one another. A suction bell 54, which has a conical cross-sectional shape, reaches around the cleaning elements 33, 34, 35. The front opening 54' of the suction bell 54 is selected in this case to be such that the environment 3 of the opening roller 4 is framed or surrounded. On the side of the cleaning head 19 which is opposite the cleaning elements 33, 34, 35, 36, one air feeding pipe 37*a* and one air discharge pipe 37*b* respectively are provided.

For the preventive cleaning of the environment 3 of an opening roller 4, the cleaning head 19 is swivelled clockwise out of the interior of the servicing apparatus 13. In this case, the suction bell 54 reaches around the area 3 to be cleaned. When the servicing apparatus 13 is moving, the cleaning head 19 is used for a less intensive cleaning of the area 3 of a spinning unit 2. While it passes by, all spinning units 2 are sucked off in which case the suction bell 54 is disposed over each area 3 of a spinning unit 2 for a short time. The suction pipes 33, 34 arranged in the suction bell 54 and the blow nozzles 35, 36 are actuated alternately. Thus, a good cleaning effect can be achieved while the servicing apparatus 13 is moving also without any mechanically acting cleaning elements.

In the following, the construction of the cleaning head 20 will be described. According to FIG. 2, several cleaning elements, particularly a compressed-air nozzle 27, a stripping wheel 28, a roll-picker needle 31, a brush 29 and a suction device 30 are arranged on the front face of the cleaning head 20. Accordingly, the cleaning head 20 has mechanical as well as pneumatic cleaning elements. The suction device 30 is connected with the servicing apparatus 13 by way of a flexible suction hose 30*a*. Likewise, the compressed-air nozzle 27 has a feeding pipe which is not shown in detail. It should be noted that the cleaning head 20 may comprise additional cleaning elements which are not shown and which are suitable for intensively cleaning the exposed parts of the area 3 of a spinning unit 2, in which case the travel of the yarn 9 is not interrupted.

When the servicing apparatus 13 is stopped, the cleaning head 20 is used for the intensive preventive cleaning of an operating spinning unit 2*b*. While, at the adjacent stopped spinning unit 2*a*, for example, a yarn breakage is eliminated, an intensive cleaning can be carried out at spinning unit 2*b*. This intensive cleaning takes place every time the servicing apparatus 13 must stop anyhow at a service-requiring spinning unit, in the present case, at the spinning unit 2*a*. The servicing time which is required for this purpose is used for the cleaning of the adjacent spinning unit 2*b* which is not stopped. In this case, the area 3*b* on this spinning unit 2*b* may be cleaned intensively in a preventive manner because, on the one hand, a longer time period is available and, on the other hand, the cleaning elements 27, 28, 29, 30, 31 may be applied more precisely.

As shown in FIG. 2, area 3 is mainly the opening and cleaning zone of the sliver, thus the opening roller 4, the feeding roller 5 and the dirt removal belt 24 which travels in a tub or trough 23.

On the side of area 3 facing the servicing apparatus 13, no covering is provided in the case of the embodiment illustrated in FIG. 2. Only the front face of the opening roller 4 is provided with a covering 49. The interior parts of area 3 of spinning unit 2 are for the most part freely accessible, as is the dirt removal belt 24. Only the area of the spinning rotor 21 is covered by a separate covering 50 which comprises the yarn withdrawal duct 22 and leaves the opening roller 4 exposed.

The free accessibility of the area 3 to be cleaned affects cleaning head 19 as well as cleaning head 20. The suction bell 54 of the cleaning head 19 and its cleaning elements 33, 34, 35, 36 can therefore be guided to close to the area 3 to be cleaned. For the cleaning elements, particularly for the roll-picker needle 31, arranged on the cleaning head 20, it is possible to penetrate deep into the area 3 to be cleaned.

A control device, in which two control programs 17 and 18 are stored, are assigned to the cleaning heads 19 and 20. Control program 17 controls the cleaning head 19 in the normal moving operation of the servicing apparatus 13. In contrast, control program 18 controls the cleaning operation of the cleaning head 20 when the servicing apparatus 13 stands still. The control device receives a signal from the driving motor of the servicing apparatus 13 which indicates the moving condition of the servicing apparatus 13. Thus, when the servicing apparatus 13 is stopped, control program 18 is used, and when it is moving, control program 17 is used.

By means of a reprogramming of the control programs 17 and 18, it is achieved that the position and direction of the cleaning elements and of the cleaning heads can be varied. As a result, additional cleaning elements are not required even if the cleaning area is large. For example, the cleaning head 19 may be programmed such that, when the servicing apparatus 13 is moving, first a lower area of the spinning unit and, in the case of another cycle, a section arranged above this area is cleaned. The reprogramming may take place by a contact which is not shown and which is mounted on the open-end spinning machine 1 and interacts with the servicing apparatus 13 during each cycle.

By means of a counterclockwise swivelling, the cleaning heads 19 and 20 may be guided to a stripping cleaning head 38 which is stationarily arranged inside the servicing apparatus 13. This cleaning head 39, for example, has a fork 39 into which the roll picker needle 31 of the upward-swivelled cleaning head 20' engages. When the fork 39, to which a drive 39*a* is assigned, is displaced in its longitudinal direction, the fibers caught by the roll-picker needle are stripped off in this case. Furthermore, the stripping wheel 28 can now be cleaned by means of a rotating brush 40. In this case, the brush 40 rotates faster than the stripping wheel 28 and has harder bristles in order to increase the cleaning effect. The dirt occurring during the cleaning is sucked-off by means of a suction pipe 41.

Figure 3:
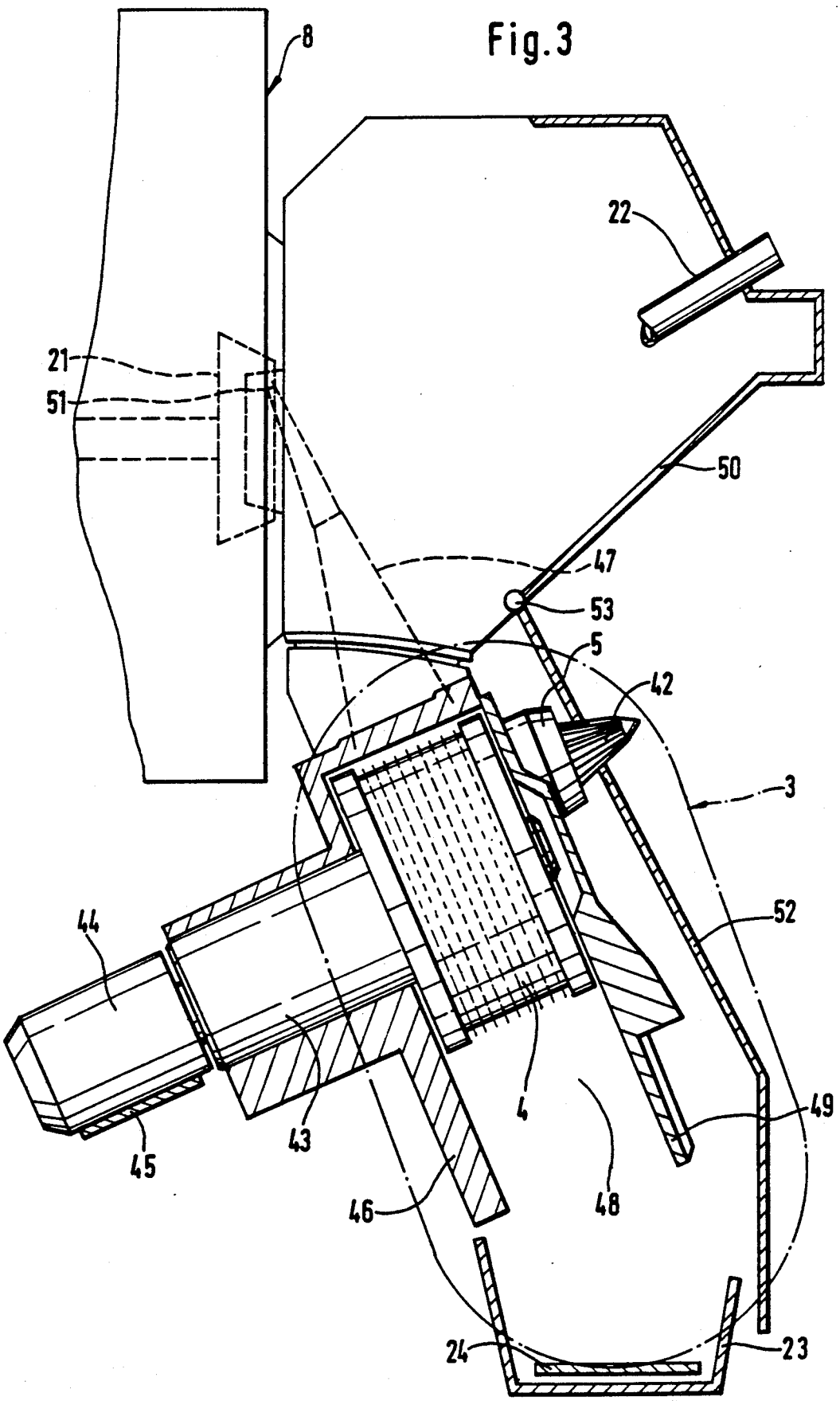
FIG. 3 is an enlarged schematic representation of a spinning station of another embodiment of the invention.

The embodiment illustrated in FIG. 3 differs from the above-described embodiment essentially by the fact that the side of the opening roller 4 facing the servicing apparatus 13 which is not shown, is covered by a covering 52 that is arranged so that it can be swivelled. The covering 52 is swivel-mounted on a joint 53 which is arranged on the lower edge of a covering 50 which covers the spinning part 8. The covering 52 extends into the area of the tub 23 in which the dirt removal belt 24 is guided.

For the cleaning of area 3, the covering 52 must be swivelled away. In the present case, this takes place by devices which are not shown in detail and which are provided on the servicing apparatus 13.

The enlarged representation of FIG. 3 also shows the detailed development of the spinning station. The spinning area 8 is shown which comprises the spinning rotor 21 which, by way of a fiber feeding duct 47, is connected with the opening roller 4. A covering 50, which covers the spinning part 8, comprises an insert 51 projecting into the spinning rotor 21. In the area 3 of the opening roller 4, a feeding roller 5 is disposed which is provided on the front face with a conical toothed wheel 42. On its side facing the servicing apparatus 13, which is not shown, the opening roller 4 is covered by means of a protective lid 49. The drive of the opening roller 4 takes place by means of a drive shaft 44 which is disposed in a bearing housing 43 held in the housing 46. The drive shaft 44 can be driven by way of a tangential belt 45.

Below the opening roller 4, a stationary tub or trough 34 is arranged in which the dirt removal belt 24 is guided. Parts of the housing 46 and of the protective lid 49, which are lengthened in the direction of the tub 23, bound a dirt discharge opening 48.

During the cleaning of area 3, the main lid 50 remains closed, while the covering 52 is folded away. Also in the case of the embodiment according to FIG. 3, a servicing apparatus 13 with swivelling cleaning heads 19 and 20 is used. The cleaning elements, which in their position and direction can be changed with respect to the area 3 to be cleaned, in this case, permit an intensive cleaning of area 3. In particular, the roll-picker needle 31 may be programmed such that during each cycle it cleans another part of area 3. Whenever it arrives at a certain point of the open-end spinning machine 1, an electronically controlled reprogramming takes place. It is therefore not necessary to equip the cleaning head 20 with a plurality of roll-picker needles 31. Thus, for example, the areas of the feeding roller 5, the protective lid 49, the dirt discharge opening 48, the dirt removal belt 24 or the opening roller housing 46 can be cleaned successively. Also, if necessary, and as a function of the respective occurrence of dirt, a differently programmed cleaning sequence is possible.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning machine comprising:

a plurality of spinning units arranged in a row which each comprise an opening roller, and movable servicing apparatus carrying cleaning elements which can be applied to respective ones of the opening rollers for carrying out preventative cleaning without interrupting spinning operations at the associated spinning unit.

wherein a control device is assigned to the cleaning elements which controls a first preventative cleaning operation without interrupting spinning operations at the associated spinning unit when the servicing apparatus is moving and a second preventative cleaning operation without interrupting spinning operations at the associated spinning unit when the servicing apparatus is stopped, said first cleaning operation being different than the second cleaning operation.

2. An open-end spinning machine according to claim 1, wherein the cleaning operation while the servicing apparatus is stopped is designed for an intensive cleaning, and the cleaning operation while the servicing apparatus is moving is designed for a less intensive cleaning.

3. An open-end spinning machine according to claim 1, wherein the control device includes at least two programmable control programs.

4. An open-end spinning machine according to claim 2, wherein the area of the opening roller of each spinning unit is freely accessible to the cleaning elements.

5. An open-end spinning machine according to claim 1, wherein the servicing apparatus is equipped with at lest two different cleaning elements, of which a first cleaning element is developed for the cleaning operating while the servicing apparatus is moving, and another cleaning element is constructed for the cleaning operation while the servicing apparatus is stopped.

6. An open-end spinning machine according to claim 5, wherein the cleaning element used when the servicing apparatus is moving is constructed with at least one pneumatic element, and the cleaning element used when the servicing apparatus is stopped is constructed with at least one mechanical element.

7. An open-end spinning machine according to claim 6, wherein the cleaning element used when the servicing apparatus is stopped is constructed with at least one pneumatic element.

8. An open-end spinning machine according to claim 7, wherein different cleaning elements are assigned to one cleaning head respectively, which respective cleaning head is swivel-mounted on the servicing apparatus.

9. An open-end spinning machine according to claim 8, comprising a stripping cleaning element for stripping the cleaning elements, wherein apparatus is provided for applying the cleaning elements to the stripping cleaning element which strips them.

10. An open-end spinning machine according to claim 5, comprising two cleaning heads swivelmounted on the servicing apparatus, wherein the different cleaning elements are assigned to one of the respective cleaning heads.

11. An open-end spinning machine according to claim 5, wherein the control device includes programmable apparatus for changing the positions of the cleaning elements with respect to the areas to be cleaned.

12. An open-end spinning machine according to claim 11, comprising a changeable control program assigned to the moving operation which can be changed during each cycle of the servicing apparatus.

13. An open-end spinning machine according to claim 1, comprising a stripping cleaning element, wherein the cleaning elements can be applied to the stripping cleaning element which strips them.

14. An open-end spinning machine according to claim 13, wherein the stripping cleaning element is constructed as a stripping cleaning head arranged in the servicing apparatus.

15. An open-end spinning machine according to claim 1, wherein the cleaning element for the cleaning operation when the servicing apparatus is stopped can be applied to a spinning unit which is adjacent to the spinning unit serviced by the servicing apparatus.

16. An open-end spinning machine according to claim 15, wherein the control device includes means for programming the position of the cleaning elements to be changeable with respect to the areas to be cleaned.

17. An open-end spinning machine according to claim 16, wherein a control program assigned to the moving operation can be changed during each cycle of the servicing apparatus.

18. An open-end spinning machine according to claim 1, wherein the area of the opening roller of each spinning unit is freely accessible to the cleaning elements.

19. An open-end spinning machine according to claim 18, comprising a swivellable covering for the opening roller, and apparatus for swivelling the covering away to expose the opening roller for cleaning operations.

20. An open-end spinning machine according to claim 18, wherein the cleaning element for the moving operation of the servicing apparatus is provided with a suction bell which is constructed so as to frame the area to be cleaned.

21. An open-end spinning machine according to claim 20, wherein the assigned cleaning elements are arranged inside the suction ball.

22. An open-end spinning machine according to claim 1, wherein the cleaning element for the moving operation of the servicing apparatus is provided with a suction bell which is constructed so as to frame the area to be cleaned.

23. An open-end spinning machine according to claim 22, wherein the assigned cleaning elements are arranged inside the suction bell.

* * * * *